US012571574B2

(12) United States Patent
Ji et al.

(10) Patent No.: US 12,571,574 B2
(45) Date of Patent: Mar. 10, 2026

(54) ICE MAKER AND REFRIGERATOR INCLUDING THE SAME

(71) Applicant: DAE CHANG CO., LTD, Gwangju (KR)

(72) Inventors: Joon Dong Ji, Suwon-si (KR); Dong Hyuk Yim, Suwon-si (KR)

(73) Assignee: DAE CHANG CO., LTD, Gwangju (KR)

( * ) Notice: Subject to any disclaimer, the term of this patent is extended or adjusted under 35 U.S.C. 154(b) by 177 days.

(21) Appl. No.: 18/280,722

(22) PCT Filed: Mar. 16, 2022

(86) PCT No.: PCT/KR2022/003652
§ 371 (c)(1),
(2) Date: Sep. 7, 2023

(87) PCT Pub. No.: WO2022/203272
PCT Pub. Date: Sep. 29, 2022

(65) Prior Publication Data

US 2024/0159441 A1 May 16, 2024

(30) Foreign Application Priority Data

Mar. 23, 2021 (KR) ..... 10-2021-0037263

(51) Int. Cl.
*F25C 5/04* (2006.01)
*F25C 5/06* (2006.01)

(52) U.S. Cl.
CPC ..... *F25C 5/04* (2013.01); *F25C 5/06* (2013.01); *F25C 2600/04* (2013.01); *F25C 2700/06* (2013.01)

(58) Field of Classification Search
CPC .... F25C 2600/04; F25C 2700/06; F25C 5/04; F25C 5/06
See application file for complete search history.

(56) References Cited

U.S. PATENT DOCUMENTS

2019/0086134 A1* 3/2019 Lee ..... F25C 1/04
2020/0080759 A1* 3/2020 Shi ..... F25C 5/22

FOREIGN PATENT DOCUMENTS

EP 2151644 A1 * 2/2010 ..... F25C 1/04
EP 1417445 B1 * 10/2010 ..... F25C 1/04
(Continued)

OTHER PUBLICATIONS

International Search Report mailed Jun. 24, 2022 for International Application No. PCT/KR2022/003652 and its English translation.

*Primary Examiner* — William C Doerrler
(74) *Attorney, Agent, or Firm* — Insight Law Group, PLLC; Seung Lee

(57) ABSTRACT

Proposed are an ice maker and a refrigerator including the ice maker. The ice maker includes a drive motor arranged inside a casing and configured to rotate an ice-making tray or an ejector pin, a gear set operating in unison with the drive motor, an in-unison operating lever provided to operate in unison with the gear set, a magnet being provided on one side of the in-unison operating lever, and a printed circuit board arranged to one side of the in-unison operating lever, a position detection sensor being provided on the printed circuit board in such a manner that an electric contact point is established according to trajectory followed by the moving magnet.

9 Claims, 6 Drawing Sheets

(56) References Cited

FOREIGN PATENT DOCUMENTS

| | | | | | |
|---|---|---|---|---|---|
| JP | 11-037621 | A | | 2/1999 | |
| JP | 2009261053 | A | * | 11/2009 | |
| KR | 10-0583345 | B | | 5/2006 | |
| KR | 10-2014-0088693 | A | | 7/2014 | |
| KR | 20140088693 | A | * | 7/2014 | ..... F25C 5/08 |
| KR | 10-2019-0026453 | A | | 3/2019 | |
| KR | 20190084447 | A | * | 7/2019 | ..... F25C 1/24 |
| KR | 10-2020-0016903 | A | | 2/2020 | |

* cited by examiner

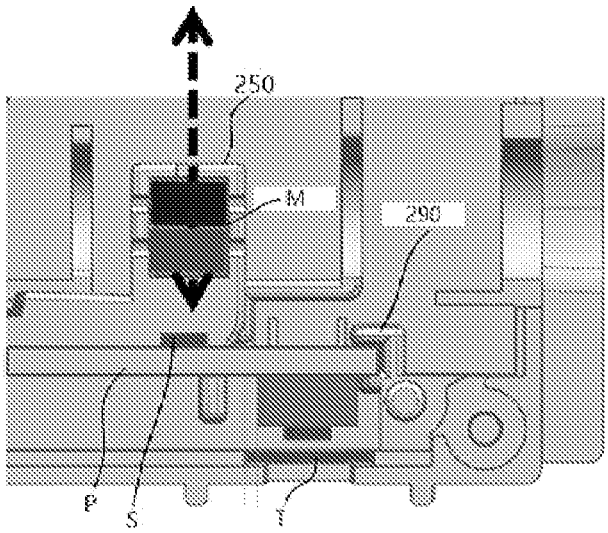
FIG. 5(a)
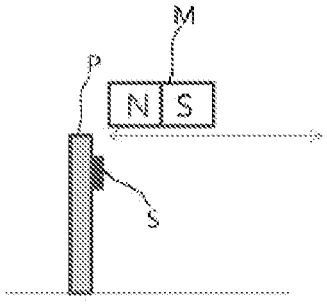
FIG. 5(b)
FIG. 6
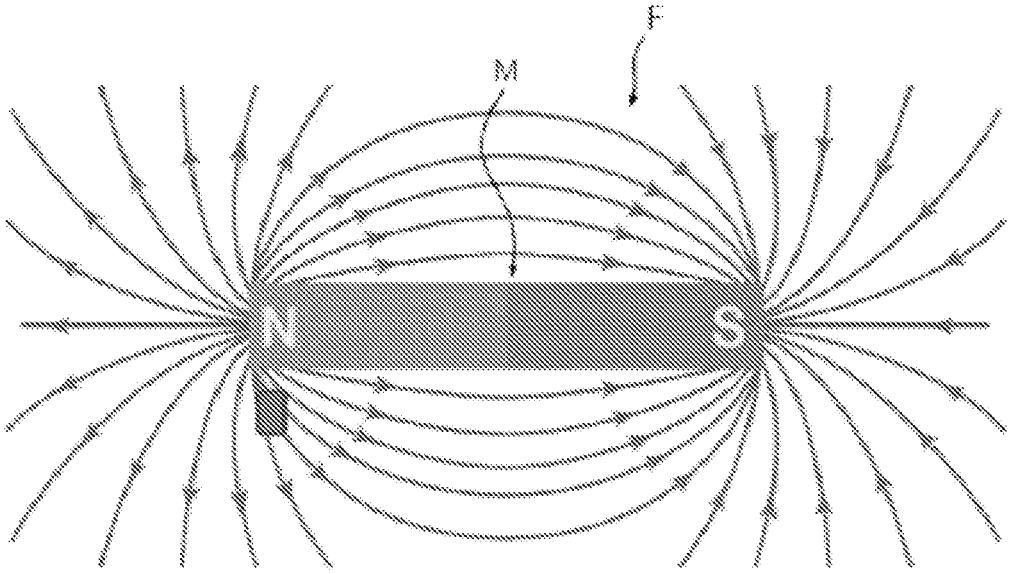

ICE MAKER AND REFRIGERATOR INCLUDING THE SAME

CROSS-REFERENCE TO RELATED APPLICATIONS

This application is a § 371 national phase entry of International Application No. PCT/KR2022/003652, filed Mar. 16, 2022, the disclosure of which is incorporated herein in its entirety by reference.

TECHNICAL FIELD

The present disclosure relates to an ice maker and a refrigerator including the ice maker.

BACKGROUND ART

Generally, an ice maker is an apparatus that is arranged to operate at a temperature below zero and is supplied with ice-making water for ice-making purposes. In order to produce ice, during manufacturing, the ice maker has to undergo a test run subject to a harsh environment.

In the test run, it is checked whether or not the ice maker properly operates in a moisture-exposed environment. Specifically, the test run is repeatedly performed while the ice-making water is sprayed. In the test run, the ice-making water has to be sprayed to ensure proper operation of the ice maker. However, there is a concern that drops of the ice-making water will splatter on the ceiling of the ice maker, thereby adversely affecting control of the ice maker.

In order to prevent this situation, an ice maker, when actually manufactured, is required to employ a structure in where moisture is not introduced into a drive box of the ice maker.

In addition, electric components, such as a drive motor and a fully-iced-state detection sensor of a fully icing lever, that are highly likely to break down or catch fire due to moisture, are mounted inside the ice maker. The drive motor is driven with electric power in order to rotate an ejector or an ice-making tray. The fully-iced-state detection sensor serves to detect whether or not ice stored in a storage unit is fully iced.

For this reason, a sensor and the like that operate by making physical contact are susceptible to moisture penetration, which can lead to malfunctioning of the ice maker.

SUMMARY OF INVENTION

Technical Problem

An object of the present disclosure, which is contrived to find a solution to the above-mentioned problem, is to provide an ice maker capable of employing an operational structure that uses a printed circuit board on which a high-sensitivity sensor is provided and thus preventing erroneous operations, such as malfunctioning, by reducing an error caused by accumulative tolerances on driving inside a drive box, and to provide a refrigerant including the ice maker.

Another object of the present disclosure is to provide an ice maker capable of employing an electric power-free drive structure that, in a drive box, uses a printed circuit board on which a high-sensitivity sensor is provided without a switch installed through a through-hole exposed to the outside and thus thoroughly preventing dust, moisture, or the like from penetrating into a drive box in which a drive unit including a motor for ice separation is installed, not only when a test run is performed on the ice maker, but also when the ice maker is actually mounted and used in a refrigerator, and to provide a refrigerator including the ice maker.

A still another object of the present disclosure is to provide an ice maker capable of employing a structure where a printed circuit board, installed inside a drive box, on which an electric power-free high-sensitivity sensor that operates with a non-contact outside force is provided is detachably attached, and thus being fixed without any separate fixation screw, and to provide a refrigerator including the ice maker.

The present disclosure is not limited to the objects mentioned above. From the following detailed description, an object not mentioned above would be clearly understandable by a person of ordinary skill in the art.

Solution to Problem

According to an aspect of the present disclosure, there is provided an ice maker including:

- a drive motor arranged inside a casing and configured to rotate an ice-making tray or an ejector pin;
- a gear set operating in unison with the drive motor;
- an in-unison operating lever provided to operate in unison with the gear set, a magnet being provided on one side of the in-unison operating lever; and
- a printed circuit board arranged to one side of the in-unison operating lever, a position detection sensor being provided on the printed circuit board in such a manner that an electric contact point is established according to trajectory followed by the moving magnet.

According to another aspect of the present disclosure, there is provided an ice maker including:

- a drive motor arranged inside a casing and configured to rotate an ice-making tray or an ejector pin;
- a gear set operating in unison with the drive motor;
- an in-unison operating lever provided to operate in unison with the gear set, a magnet, which forms a magnetic field to one side thereof, being provided on the in-unison operating lever; and
- a printed circuit board vertically arranged to one side of the in-unison operating lever in a direction orthogonal to a bottom surface of the casing, a Hall sensor being provided on the printed circuit board in such a manner that an electric contact point is established according to trajectory followed by the moving magnet,
- wherein the trajectory followed by the moving magnet changes in such a manner that, for positioning, an N-pole of the magnet approaches the Hall sensor earlier than an S-pole thereof.

According to still another aspect of the present disclosure, there is provided an ice maker including:

- a drive motor arranged inside a casing and configured to rotate an ice-making tray or an ejector pin;
- a gear set operating in unison with the drive motor;
- an in-unison operating lever provided to operate in unison with the gear set, a magnet, which forms a magnetic field to one side thereof, being provided on the in-unison operating lever; and
- a printed circuit board vertically arranged to one side of the in-unison operating lever in a direction orthogonal to a bottom surface of the casing, a Hall sensor being provided on the printed circuit board in such a manner that an electric contact point is established according to trajectory followed by the moving magnet, wherein the trajectory followed by the moving magnet changes in such a manner that, for positioning, an N-pole of the magnet approaches the Hall sensor earlier than an S-pole thereof and, when the magnet on the in-unison operating lever approaches a Hall sensor on the printed circuit board or is positioned to be spaced apart therefrom, an output signal changes.

In the ice maker, a detection signal may be output when the magnet on the in-unison operating lever is positioned to be adjacent to the position detection sensor in a manner that is spaced apart therefrom, and an electric contact point signal may be output according to the detection signal.

In the ice maker, the printed circuit board may be structurally slot-inserted into a molded portion of the casing.

In the ice maker, a test switch for determining whether or not the ice maker properly operates may be provided on the casing.

In the ice maker, the printed circuit board may be arranged in a direction in parallel with the test switch provided on the casing.

In the ice maker, the position detection sensor may be a Hall sensor.

The ice maker may further include a fully-iced-state detection lever provided on one side of the casing.

In the ice maker, in a case where the magnet on the in-unison operating lever rotates, an N-pole of the magnet may approach the position detection sensor more preferentially than an S-pole thereof.

In the ice maker, the gear set may include:

a worm gear axially rotating by being coupled to a rotational shaft of the drive motor;

a worm wheel gear rotating by being engaged with the worm gear; and an output gear rotating by being engaged with the worm wheel gear and axially coupled to a rotational shaft of the in-unison operating lever.

According to still another of the present disclosure, there is provided a refrigerator including the ice maker.

Advantageous Effects of Invention

An ice maker according to the present disclosure employs an operational structure that uses a printed circuit board on which a high-sensitivity sensor is provided. A refrigerator includes the ice maker with this structure. Thus, the effect of preventing erroneous operations, such as malfunctioning, by reducing an error caused by accumulative tolerances on driving inside a drive box can be achieved.

In addition, an ice maker according to the present disclosure employs an electric power-free drive structure that, in a drive box, uses a printed circuit board on which a high-sensitivity sensor is provided without a switch installed through a through-hole exposed to the outside. A refrigerator includes the ice maker with this structure. Thus, the effect of thoroughly preventing dust, moisture, or the like from penetrating into a drive box in which a drive unit including a motor for ice separation is installed, not only when a test run is performed on the ice maker, but also when the ice maker is actually mounted and used in the refrigerator can be achieved.

In addition, an ice maker according to the present disclosure employs a structure where a printed circuit board, installed inside a drive box, on which an electric power-free high-sensitivity sensor that operates with a non-contact outside force is provided is detachably attached. A refrigerator includes the ice maker with this structure. Thus, the effect of fixing the ice maker without any separate fixation screw can be achieved.

BRIEF DESCRIPTION OF DRAWINGS

FIGS. 5(*a*) and 5(*b*) are vertical cross-sectional views each illustrating one portion of the inside of the drive box according to the embodiment of the present disclosure.

FIG. 6 is a view illustrating a state where a magnetic field is formed, the state being sensed by a Hall sensor according to the embodiment of the present disclosure.

DESCRIPTION OF EMBODIMENTS

Figure 1:
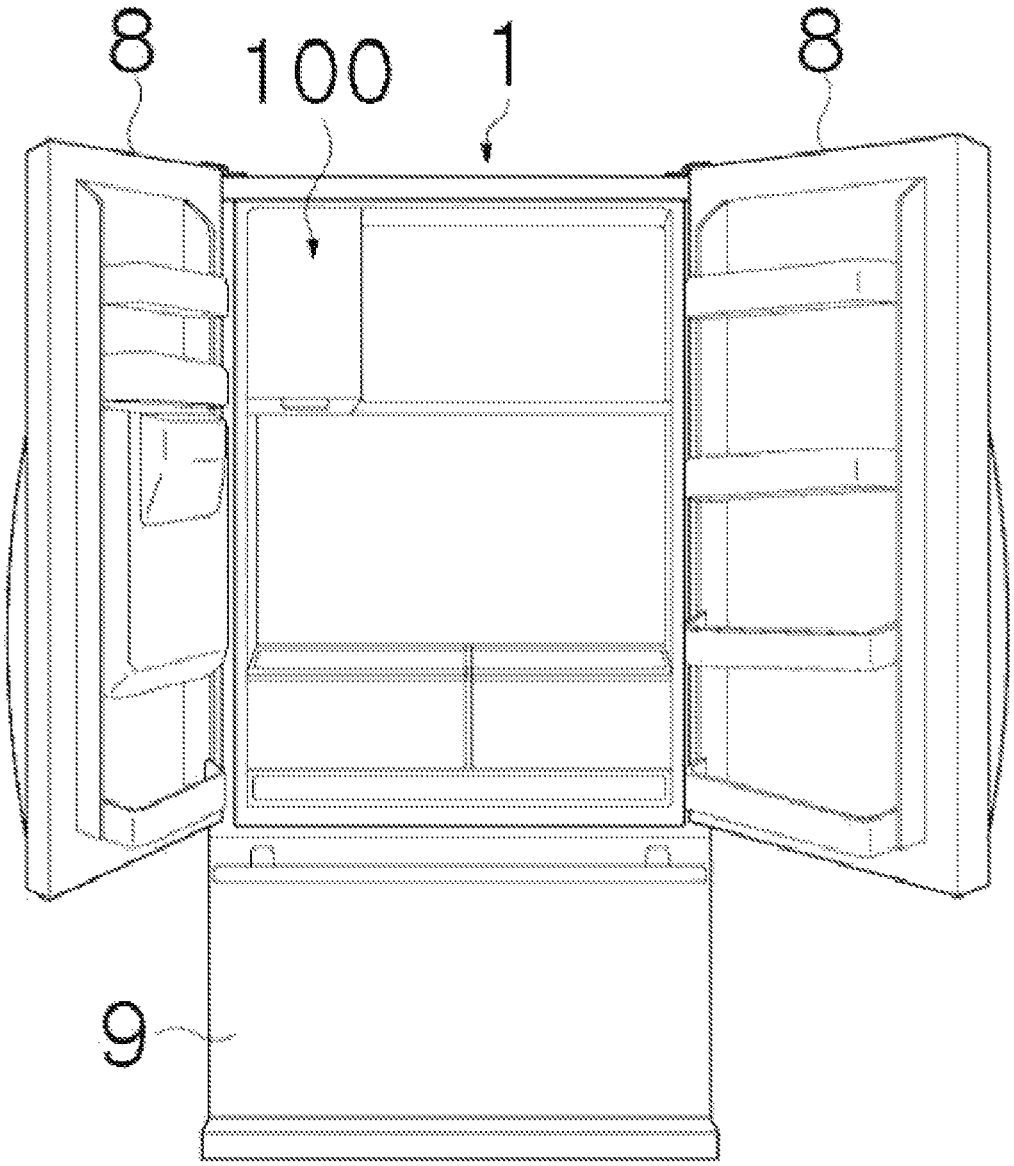
FIG. 1 is a perspective view illustrating an interior state of a refrigerator that is equipped with an ice maker according to an embodiment of the present disclosure.

An embodiment of the present disclosure will be described in detail below with reference to the accompanying drawings. It should be noted that, in assigning a reference numeral to a constituent element that is illustrated in the drawings, the same constituent element, although illustrated in different drawings, is designated by the same reference numeral, if possible, throughout the drawings. In addition, a detailed description of a well-known configuration or function that is associated with the embodiment of the present disclosure will be omitted when determined as making the nature and gist of the present disclosure obfuscated.

The ordinal numbers, first, second, and so forth, the letters in upper case A, B, and so for the, and the parenthesized letters in lower case, (a), (b), and so forth may be used to name constituent elements according to the embodiment of present disclosure. These ordinal numbers and letters are used only to distinguish among the same constituent elements, and do not impose any limitation on the natures of the same constituent elements or the order thereof. Unless otherwise defined, all terms, including technical or scientific terms, which are used in the present specification, have the same meanings as are normally understood by a person of ordinary skill in the art to which the present disclosure pertains. The term as defined in a dictionary in general use should be construed as having the same meaning as interpreted in context in the relevant technology, and, unless otherwise explicitly defined in the present specification, is not construed as having a prototypical meaning or an excessively literal meaning.

Figure 2:
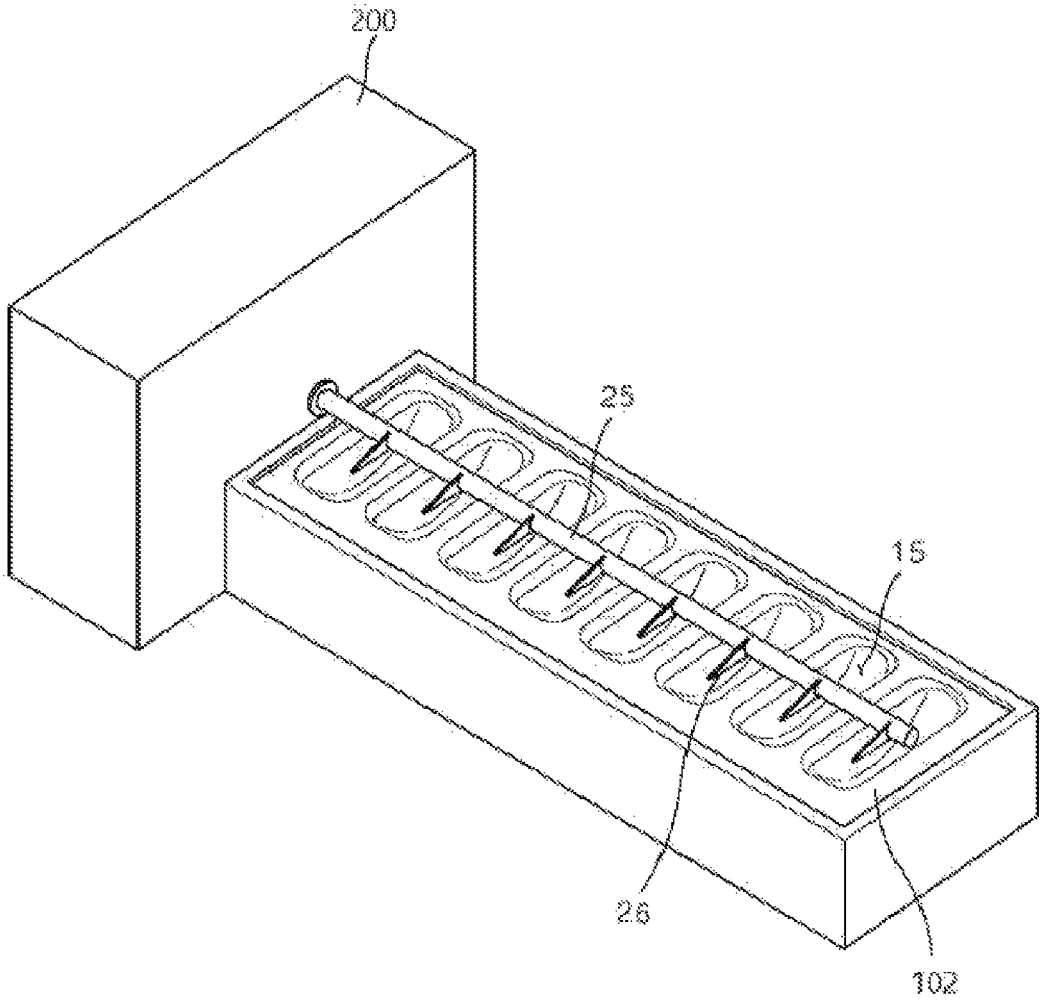
FIG. 2 is a perspective view illustrating a heater-type ice maker that is an implementation example of the ice maker according to the embodiment of the present disclosure.
Figure 3:
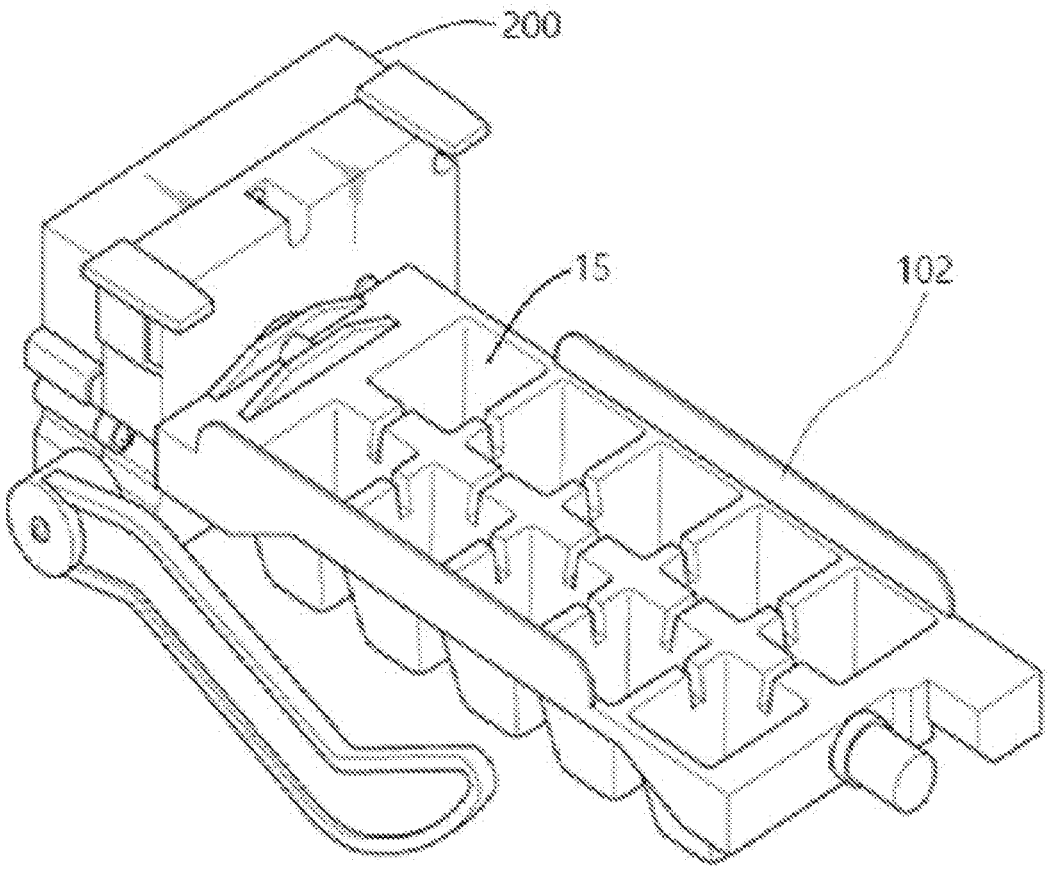
FIG. 3 is a perspective view illustrating a twist-type ice maker that is another implementation example of the ice maker according to the embodiment of the present disclosure.

FIG. 1 is a perspective view illustrating an interior state of a refrigerator that is equipped with an ice maker according to the embodiment of the present disclosure. FIG. 2 is a perspective view illustrating a heater-type ice maker. FIG. 3 is a perspective view illustrating a twist-type ice maker.

First, with reference to FIG. 1, a refrigerator 1 may include a cabinet that forms a storage compartment open at the front and at least one door 8 or 9 that is used to open and close the storage compartment.

The storage compartment includes at least one of a refrigerating compartment for storing food in a refrigerated state and a freezing compartment for storing food in a frozen state. The refrigerator 1 according to the present embodiment exemplifies a refrigerator that includes both the refrigerating compartment and the freezing compartment. The refrigerating compartment may be provided on top of the freezing compartment.

The doors 8 and 9 may refer to a refrigerating compartment door 8 and a freezing compartment door 9, respectively. The refrigerating compartment door 8 is used to open and close the refrigerating compartment, and the freezing compartment door 9 is used to open and close the freezing compartment. The refrigerating compartment door 8 may consist of two freezing compartment doors that are arranged to the left and right sides. The left-side refrigerating compartment door 8 may be used to open and close the left side of the refrigerating compartment. The right-side refrigerating compartment door 8 may be used to open and close the right left side of the refrigerating compartment.

An ice maker 100 according to the present embodiment may be installed in at least one of the refrigerating compartment and the freezing compartment. The ice maker 100 may be installed in the upper left section of the refrigerating compartment of the refrigerator 1 according to the present embodiment.

The ice maker 100 may be provided with ice-making water from the refrigerator 1. The ice maker 100 may convert the ice-making water into ice using cold air supplied to the storage compartment during a refrigeration cycle for the refrigerator 1. In this manner, ice cubes may be manufactured.

Implementation examples of the ice maker 100 may include a heater-type ice maker and a twist-type ice maker, depending on how the resulting ice is separated into ice cubes.

Specifically, as illustrated in FIG. 2, the heater-type ice maker that is an implementation example of the ice maker 100 according to the embodiment of the present disclosure may include a drive box 200, an ice-making tray 102, and a bar-shaped ejector 20. An electric component and a drive component are mounted within the drive box 200. The ice-making tray 102 is provided on one side of the drive box 200, and a multiplicity of ice-making grooves 15 are formed in an upper surface of the ice-making tray 102. The ejector includes ejector pins 25 and is arranged over the ice-making tray 102. The ejector 20 ejects the ice cubes into which the resulting ice is separated.

A printed circuit board (refer to FIG. 3), a drive motor (refer to FIG. 3), a gear set (refer to FIG. 3), and an in-unison operating lever (refer to FIG. 3) are mounted within the drive box. A microcomputer (not illustrated), which serves to a substantial control unit, and various electric components for driving the microcomputer are mounted on the printed circuit board. The drive motor is driven with electric power. The gear set operates in unison with the drive motor. The in-unison operating lever is provided in a manner that operates in unison with the gear set. The printed circuit board, the drive motor, the gear set, and the in-unison operating lever will be described in more detail below with reference to the accompanying drawings.

As illustrated in FIG. 3, the twist-type ice maker that is another implementation example of the ice maker according to the embodiment of the present disclosure may include a casing 210, and an ice-making tray 102. The drive box 200 is the same as the drive box 200 of the heater-type ice maker. The casing 210 forms the exterior appearance of the drive box 200. A multiplicity ice-making grooves 15 are formed in an upper surface of the ice-making tray 102 and is provided on one side of the casing 210 in a manner that is rotatable at a predetermined angle.

The heater-type ice maker and the twist-type ice maker are distinguished from each other, depending on whether or not an ice separating heater (not illustrated) and the ice-making tray 102 rotate in a twisted manner. Particularly, a position of the drive motor arranged inside the drive box 200 and a design of the gear set may vary according to whether the ice maker is the heater-type ice maker or the twist-type ice maker.

The heater-type ice maker is described. When ice-making water freezes in the ice-making grooves 15 in the ice-making tray 102, the ice separating heater applies heat to the ice-making tray 102 to a predetermined temperature and thus separates the resulting ice into ice cubes. Then, the drive motor and the gear set, which are provided inside the drive box 200, operate in unison with each other to rotate the bar-shaped ejector 20 on which the multiplicity of ejector pins 25 are provided. This operation allows the multiplicity of ejector pins 25 to rotate in such a manner that the ice cubes, into which the resulting ice is separated, drop into an ice cube storage container (not illustrated) placed under the ice-making tray 102.

In addition, the twist-type ice maker is described. When ice-making water freezes in the ice-making grooves 15 in the ice-making tray 102, the drive motor and the gear set operate in unison with each other to rotate in one direction the ice-making tray 102 directly connected to any one of gear shafts of the gear set. Thus, the ice-making tray 102 is twisted due to rotation of one end portion thereof relative to the other end portion. This twisting of the ice-making tray 102 separates the resulting ice in the ice-making grooves 15 into ice cubes, and the ice cubes drop into the ice cube storage container placed under the ice-making tray 102 for being stored therein.

Figure 4:
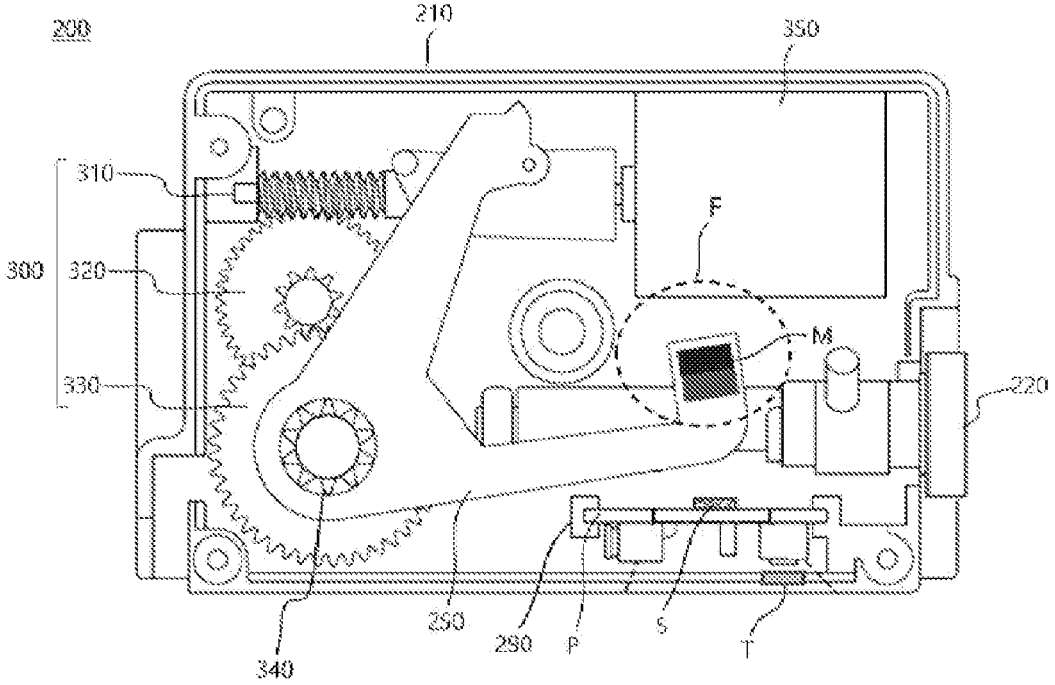
FIG. 4 is a vertical cross-sectional view illustrating the inside of a drive box according to the embodiment of the present disclosure.
Figure 7:
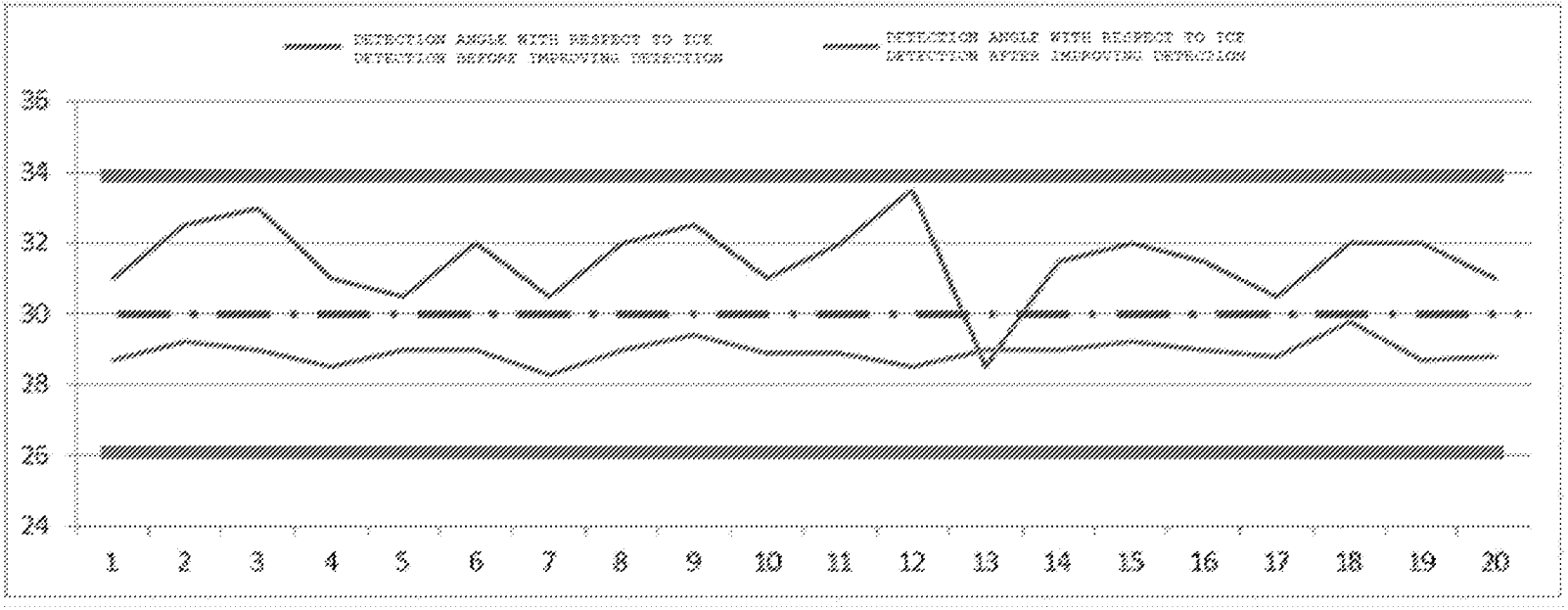
FIG. 7 is a graph showing a change in an angle for ice detection according to the embodiment of the present disclosure.

FIG. 4 is a vertical cross-sectional view illustrating the inside of the drive box according to the embodiment of the present disclosure. FIGS. 5(*a*) and 5(*b*) are vertical cross-sectional views each illustrating one portion of the inside of the drive box according to the embodiment of the present disclosure. FIG. 6 is a view illustrating a state where a magnetic field is formed, the state being sensed by a Hall sensor according to the embodiment of the present disclosure. FIG. 7 is a graph showing a change in an angle for ice detection according to the embodiment of the present disclosure.

With reference to FIGS. 4 to 7, the drive box 200 of the ice maker 100 according to the present disclosure may include a drive motor 350, a gear set 300, an in-unison operating lever 250, and a printed circuit board P. The drive motor 350 is arranged inside the casing 210 and serves to rotate the ice-making tray 102. The gear set 300 operates in unison with the drive motor 350. The in-unison operating lever 250 is provided in such a manner as to operate in unison with the gear set 300. A magnet M is provided on one side of the in-unison operating lever 250. The printed circuit board P is arranged to one side of the in-unison operating lever 250. A position detection sensor S is provided on the printed circuit board P in such a manner that an electric contact point is established according to trajectory followed by the moving magnet M.

The drive box 200 may have the casing 210 in the shape of a cuboid that is open at one side and has a predetermined space. An open side of the casing 210 of the drive box 200 may be closed by a box cover (not illustrated). As described above, a drive motor 220, the gear set 300, and the in-unison operating lever 250 may be provided inside the casing 210 of the drive box 200. The drive box 200 may employ a structure in which an upper casing (not illustrated) and a lower casing (not illustrated) that make up one pair are fastened to each other.

In this case, the printed circuit board P may be structurally fixed by fastening to each other the upper casing, on which a molded portion 290 is provided, and the lower casing. According to the situation, the drive box 200 may be formed as a single piece. That is, the drive box 200 may be formed as a single piece instead of being formed by coupling the upper casing and the lower casing that make up one pair. Thus, the drive box 200 may be configured to thoroughly block foreign material, such as moisture or dust, from penetrating from the outside.

The drive motor 220 is driven with electric power. The drive motor 220 may be provided in such a manner that a rotational shaft (not illustrated) thereof is transversely arranged inside the drive box 200. The gear set 300 may be provided on a rotational shaft of the drive motor 220.

In this case, the gear set 300 may include a worm gear 310, a worm wheel gear 320, an output gear 330, an axial gear 340, and the in-unison operating lever 250. The worm gear 310 has worm gear teeth. A central portion of the worm gear 310 is axially coupled to the rotational shaft of the drive motor 220 and thus rotates in unison with the rotational shaft. The worm wheel gear 320 has worm wheel gear teeth that are engaged with the worm gear teeth, respectively, of the worm gear 310 and thus rotates in unison with the worm gear 310. The output gear 330 has output gear teeth that are engaged with the worm wheel gear teeth, respectively, of the worm wheel gear 320 and thus rotates in unison with the worm wheel gear 320. The axial gear 340 has axial gear teeth that are engaged with the output gear teeth of the output gear 330 and thus concentrically rotates in unison with the output gear 330. The in-unison operating lever 250 is axially coupled to the axial gear 340 and thus concentrically operates in unison with the axial gear 340. In this case, the output gear 330 and the axial gear 340 may be formed as a single piece.

The in-unison operating lever 250 may be formed in the shape of an arch in such a manner that a center portion thereof that is engaged with the axial gear 340 extends over a predetermined distance. A drive shaft 220 may be connected to the ice maker 100. The drive shaft 220 transfers rotational power in unison with the in-unison operating lever 250 in such a manner that the resulting ice in the above-described ice-making groove 15 in the ice maker 100 is separated into ice cubes.

The magnet M for operating the Hall sensor S, which is capable of detecting an outside magnetic force in a non-contact manner, on the printed circuit board P may be provided on one end portion of the in-unison operating lever 250. That is, in a case where the outside magnetic force is exerted, an attractive force is generated, the magnet M on the in-unison operating lever 250 may approach toward the Hall sensor S on the printed circuit board P, and thus the Hall sensor S on the printed circuit board P may easily detect a magnetic field. According to the situation, the magnet M may be formed on one end portion of the in-unison operating lever 250 in a manner that is exposed to the outside or buried into the one end portion.

As a result, a separate through-hole is no longer necessary not only to perform a test run of the ice maker 100, but also to install a separate test switch on the drive box 200 during use of the ice maker 100. Thus, a situation where dust or moisture penetrates from the outside can be thoroughly prevented.

Moreover, the magnet M may be provided on one end portion of the in-unison operating lever 250 according to the present disclosure in such a manner that the magnet M is positioned adjacent to the Hall sensor S on the printed circuit board P and that, when the magnet M rotates, the N-pole of N and S-poles thereof preferentially approaches the Hall sensor S. That is, as illustrated in FIG. 5(*b*), the Hall sensor S on the printed circuit board P is arranged in a direction in which the Hall sensor S proactively approaches the trajectory followed by the rotating N-pole of the magnet M. The feature of the Hall sensor S on the printed circuit board P is that the Hall sensor S is provided at a position where excellent sensitivity is possibly achieved in an effective neighboring range where a magnetic field region F of the magnet M is formed. From FIG. 7, it can be seen that in the ice maker 100 according to the present disclosure, deviation of a detection angle decreases with respect to an ice detection shaft of the in-unison operating lever 250. As a result, accuracy and reliability levels of stationary, rotational, and rice-detection positions of the ice maker 100 can be greatly increased.

That is, according to the present disclosure, the ice maker 100 employs an operational structure in which the Hall sensor S provided on the printed circuit board P performs high-sensitivity sensing. As a result, deviations resulting from accumulative tolerances on sensitivity and magnet Gauss and resulting from comprehensive dispersions of errors in various components can be decreased while driving is performed inside the drive box 200. Thus, the ice maker 100 can be prevented from performing erroneous operations, such as malfunctioning.

Specifically, the magnet M may be provided on one end portion of the in-unison operating lever 250 according to the present disclosure in a manner that is exposed to the outside or buried into the one end portion. The magnet M is not limited in shape and position as long as it is configured in such a manner that the sensitivity with which the Hall sensor S on the printed circuit board P senses the occurrence of the magnetic field can be improved.

The magnet M, as described, may be provided on one end portion of the in-unison operating lever 250 in such a manner that the N-pole of the magnet M is arranged close to the Hall sensor S on the printed circuit board P. The Hall sensor S on the printed circuit board P may be arranged at an optimal position on the printed circuit board P, considering the range where the magnetic field region F is formed. That is, as illustrated in FIG. 6, magnetic fields may be formed in circular or oval shapes with the N-pole and the S-pole at their respective centers and may be formed in the radial directions in semi-oval shapes from the N-pole and S-pole of the magnet M, respectively. The reason for this is to cause the N-pole of the magnet M to approach toward the Hall sensor S on the printed circuit board P in a most preferential manner, considering a path along which the magnet provided on the end portion of the in-unison operating lever 250 rotates, in a case where the in-unison operating lever 250 rotates in one direction. As a result, in a case where the rotation of the in-unison operating lever 250 brings the N-pole of the magnet M adjacent to the Hall sensor S on the printed circuit board P, the Hall sensor S on the printed circuit board P that is arranged in the effective range where the magnetic field region F is formed closest may perform sensing in a more efficient manner without an operating error.

Sensing operation of the Hall sensor S provided on the printed circuit board P in the drive box 200 will be described below.

First, the drive motor 350 that is driven by being supplied with electric power from the outside is provided in the drive box 200. The gear set 300 is connected to a central shaft of the drive motor 350. The gear set 300 includes the worm gear 310, the worm wheel gear 320 engaged with the worm gear 310, the output gear 330 engaged with the worm wheel gear 320, the axial gear 340 engaged with the output gear 330, and the in-unison operating lever 250 coupled to the output gear 330. With this configuration, the driving of the drive motor 350 operates the gears in the gear set 300, and thus the in-unison operating lever 250 coupled to the output gear 330 operates. This operation of the in-unison operating lever 250 rotates the drive shaft 220.

At this point, in a case where the in-unison operating lever 250 rotates, the magnet M provided on the end portion of the in-unison operating lever 250 approaches the Hall sensor S on the printed circuit board P that is arranged adjacent to the magnet M. The approaching causes an attractive force, and the Hall sensor S on the printed circuit board P detects the attractive force. At this point, the N-pole of the magnet M proactively approaches the Hall sensor S, and thus, as described above, the sensitivity of the Hall sensor S can be greatly improved.

According to the present disclosure, as illustrated in FIGS. 4 and 5, the printed circuit board P may be structurally coupled to the molded portion 290 provided on the drive box 200 using a sliding-enabled mechanism or a hook-fastening mechanism. In addition, the printed circuit board P may be arranged in a direction in parallel with a test switch T provided on the casing 210, and thus may be easily attached and detached.

The specific embodiment of the present disclosure will be described in detail above with reference to the accompanying drawings. However, the present disclosure is not necessarily limited to the embodiment of the present disclosure, and it would be apparent to a person of ordinary skill in the art to which the present disclosure pertains that various modifications may be made thereto the embodiment and that a range of equivalents of the embodiment may be implemented. Therefore, the proper scope of the present disclosure should be defined by the following claims.

What is claimed is:

1. An ice maker comprising:

a drive motor arranged inside a casing and configured to rotate an ice-making tray or an ejector pin;

a gear set operating in unison with the drive motor;

an in-unison operating lever provided to operate in unison with the gear set, a magnet being provided on one side of the in-unison operating lever; and a printed circuit board arranged to one side of the in-unison operating lever, wherein the printed circuit board is slot-inserted into a molded portion of the casing, and a position detection sensor is provided on the printed circuit board in a manner that an electric contact point is established according to trajectory followed by the moving magnet, wherein an N-pole of the magnet approaches the position detection sensor more preferentially than an S-pole thereof.

2. The ice maker of claim 1, wherein a detection signal is output when the magnet on the in-unison operating lever is positioned to be adjacent to the position detection sensor in a manner that is spaced apart therefrom, and an electric contact point signal is output according to the detection signal.

3. The ice maker of claim 1, wherein a test switch for determining whether or not the ice maker properly operates is provided on the casing.

4. The ice maker of claim 3, wherein the printed circuit board is arranged in a direction in parallel with the test switch provided on the casing.

5. The ice maker of claim 1, wherein the position detection sensor is a Hall sensor.

6. The ice maker of claim 1, further comprising:

a fully-iced-state detection lever provided on one side of the casing.

7. The ice maker of claim 1, wherein the gear set comprises:

a worm gear axially rotating by being coupled to a rotational shaft of the drive motor;

a worm wheel gear rotating by being engaged with the worm gear; and an output gear rotating by being engaged with the worm wheel gear and axially coupled to a rotational shaft of the in-unison operating lever.

8. A refrigerator comprising:

the ice maker of claim 1.

9. An ice maker comprising:

a drive motor arranged inside a casing and configured to rotate an ice-making tray or an ejector pin;

a gear set operating in unison with the drive motor;

an in-unison operating lever provided to operate in unison with the gear set, a magnet, which forms a magnetic field to one side thereof, being provided on the in-unison operating lever; and a printed circuit board vertically arranged to one side of the in-unison operating lever in a direction orthogonal to a bottom surface of the casing, wherein the printed circuit board is slot-inserted into a molded portion of the casing, and a Hall sensor is provided on the printed circuit board in such a manner that an electric contact point is established according to trajectory followed by the moving magnet, wherein the trajectory followed by the moving magnet changes in such a manner that, for positioning, an N-pole of the magnet approaches the Hall sensor earlier than an S-pole thereof and, when the magnet on the in-unison operating lever approaches a Hall sensor on the printed circuit board or is positioned to be spaced apart therefrom, an output signal changes.

* * * * *